US007219740B2

(12) United States Patent
Saucier

(10) Patent No.: US 7,219,740 B2
(45) Date of Patent: May 22, 2007

(54) WELL PRODUCTION AND MULTI-PURPOSE INTERVENTION ACCESS HUB

(75) Inventor: Brian J. Saucier, Magnolia, TX (US)

(73) Assignee: Energy Equipment Corporation, Houston, TX (US)

( * ) Notice: Subject to any disclaimer, the term of this patent is extended or adjusted under 35 U.S.C. 154(b) by 0 days.

(21) Appl. No.: 11/284,600

(22) Filed: Nov. 22, 2005

(65) Prior Publication Data

US 2006/0108120 A1 May 25, 2006

Related U.S. Application Data

(60) Provisional application No. 60/630,009, filed on Nov. 22, 2004.

(51) Int. Cl.
*E21B 29/12* (2006.01)

(52) U.S. Cl. ..... 166/366; 166/344; 166/367

(58) Field of Classification Search ..... 166/339, 166/342, 344, 345, 349, 366, 367
See application file for complete search history.

(56) References Cited

U.S. PATENT DOCUMENTS 3,602,302 A * 8/1971 Kluth ..... 166/336
3,777,812 A * 12/1973 Burkhardt et al. ..... 166/338
3,834,460 A * 9/1974 Brun et al. ..... 166/341
4,378,848 A * 4/1983 Milberger ..... 166/351
4,732,215 A * 3/1988 Hopper ..... 166/366
4,848,474 A * 7/1989 Parizot et al. ..... 166/366
4,848,475 A 7/1989 Dean et al.
5,025,865 A * 6/1991 Caldwell et al. ..... 166/366
5,159,982 A 11/1992 Hynes
6,059,039 A * 5/2000 Bednar et al. ..... 166/344
6,082,460 A 7/2000 June
6,213,215 B1 * 4/2001 Breivik et al. ..... 166/350
6,494,266 B2 12/2002 Bartlett et al.
6,640,901 B1 * 11/2003 Appleford et al. ..... 166/357
7,093,661 B2 * 8/2006 Olsen ..... 166/357
7,108,069 B2 * 9/2006 Killie et al. ..... 166/336
2003/0180096 A1 9/2003 Appleford et al.

* cited by examiner

*Primary Examiner*—Thomas A Beach
(74) *Attorney, Agent, or Firm*—Conley Rose, P.C.

(57) ABSTRACT

A well production and multi-purpose intervention access hub for flowing fluids from multiple wells to a host facility through a flowline. The hub comprises a production header module and a flowline header module configured for fluid communication with the flowline. The production header module and the flowline header module connect to form a hub bore that is in fluid communication with the flowline and extends through the utility interface. A utility module may connect with the hub for fluid communication and mechanical tool intervention access with the hub bore. The hub comprises valves for isolating the fluid communication between a well the hub bore from the fluid communication between another well and the hub bore. The valves also allow fluid communication between an isolated well and the utility module upon connection of the utility module to the hub.

56 Claims, 7 Drawing Sheets

WELL PRODUCTION AND MULTI-PURPOSE INTERVENTION ACCESS HUB

CROSS-REFERENCE TO RELATED APPLICATIONS

This application claims the benefit of 35 U.S.C. 119(e) from U.S. Provisional Application Ser. No. 60/630,009, filed Nov. 22, 2004 and entitled "Well Production Hub", hereby incorporated herein by reference for all purposes.

STATEMENT REGARDING FEDERALLY SPONSORED RESEARCH OR DEVELOPMENT

Not Applicable.

BACKGROUND

Subsea oil/gas fields may have a plurality of wells linked to a host facility that receives the oil/gas via flowlines. Such a field may have a subsea well architecture that employs either single or dual flowlines designed in a looped arrangement with in-line pipe line end termination ("PLET") units positioned at selective locations for well access. The linkage between wells creates a need for PLETs to be deployed within prescribed target box areas to allow for well jumper connections to the flowline. These typically non-recoverable PLETS sit directly on unconsolidated soils on the seafloor and support connectors that allow fluid flow access between the wells and the flowline. Well jumpers connect the production trees on the wells to the flowline through the flowline connectors. For well testing or intervention operations, unless a well can be accessed through the tree, selected flowlines may be depressurized and a well isolated to flow fluids to or from a well. The PLET structure is also not typically recoverable by a mobile offshore drilling unit ("MODU") once installed.

The subsea oil/gas field may also include processing systems or production manifolds between the wells and the u facility. Using a manifold system, each well has a well jumper attached to a manifold, consisting of either single or dual flowline headers accepting production from a single well jumper distributed into single or dual flowlines. The manifold provides flowline access valves to selectively isolate wells. In this manner, fluids may flow to or from an isolated well without having to depressurize both of the flowlines. Fluid flow and mechanical access for testing, intervention, or other operations may be done through direct connection with each well tree. Fluids may also flow to or from an isolated well from the host facility through one or both of the flowlines. If only one of the flowlines is depressurized, the dual well jumpers allow for fluid flow from the non-isolated wells to the non-depressurized flowline.

Independent of the well architecture, operational activities are typically performed on well throughout the life of the well. For example, well operations may include well/flowline circulation, intervention activities, bull heading/well kill, corrosion management, de-waxing, scale removal, or pigging. These and other well operations may be performed by connecting tools directly at the subsea wellhead/subsea tree location and/or at the host production facility. The direct access into the wellhead/subsea tree typically requires intervention vessels, special intervention tooling, shut-in of production and depressurization of at least selected flowline sections, multiple rig mooring, and additional anchor handling due to the satellite offsets between the wells.

BRIEF DESCRIPTION OF THE DRAWINGS

For a more detailed description of the embodiments, reference will now be made to the following accompanying drawings.

DETAILED DESCRIPTION OF THE EMBODIMENTS

Figure 1:
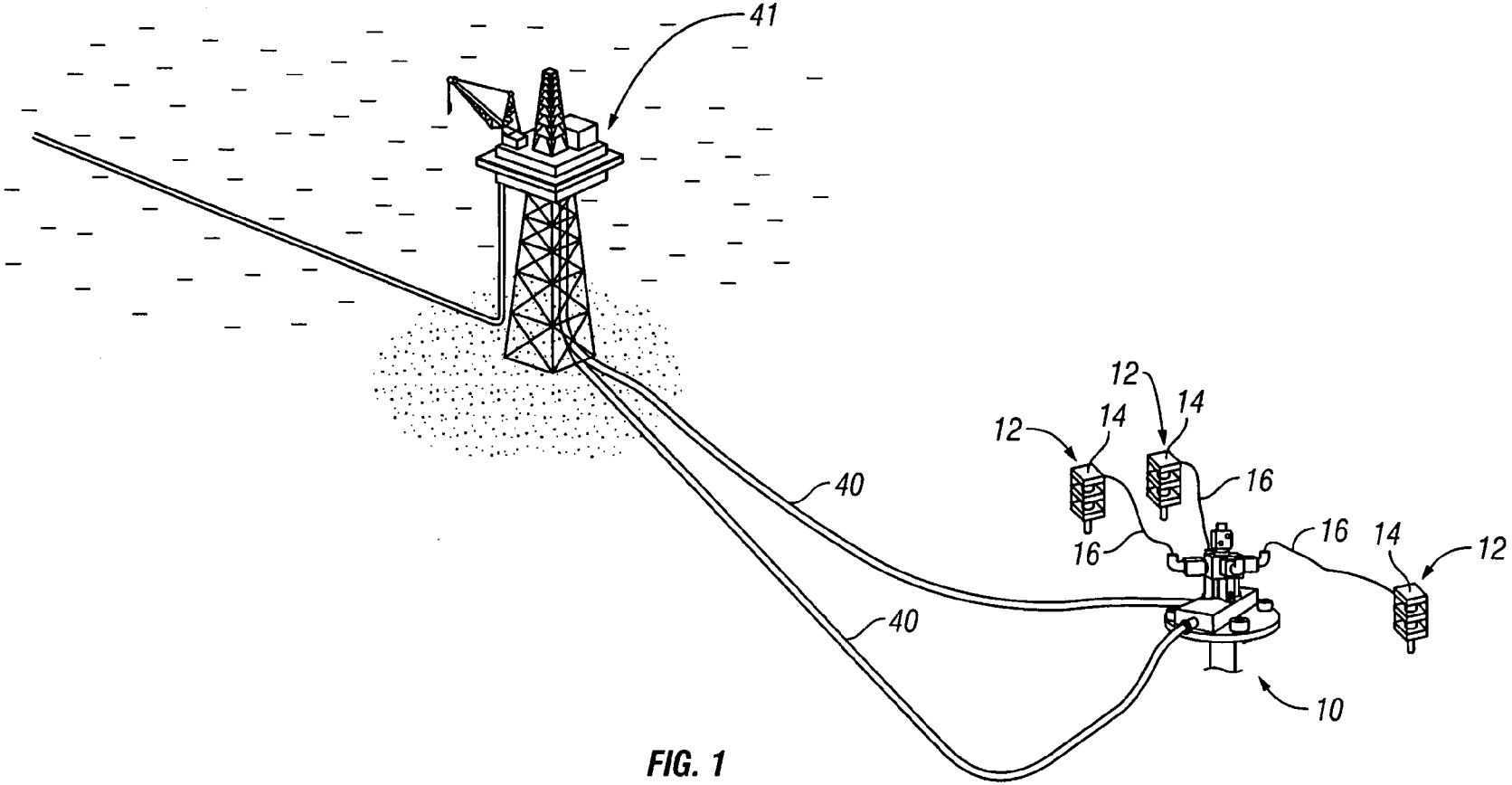
FIG. 1 is an perspective view of a subsea well field architecture with a well production hub.

In the drawings and description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

Figure 2:
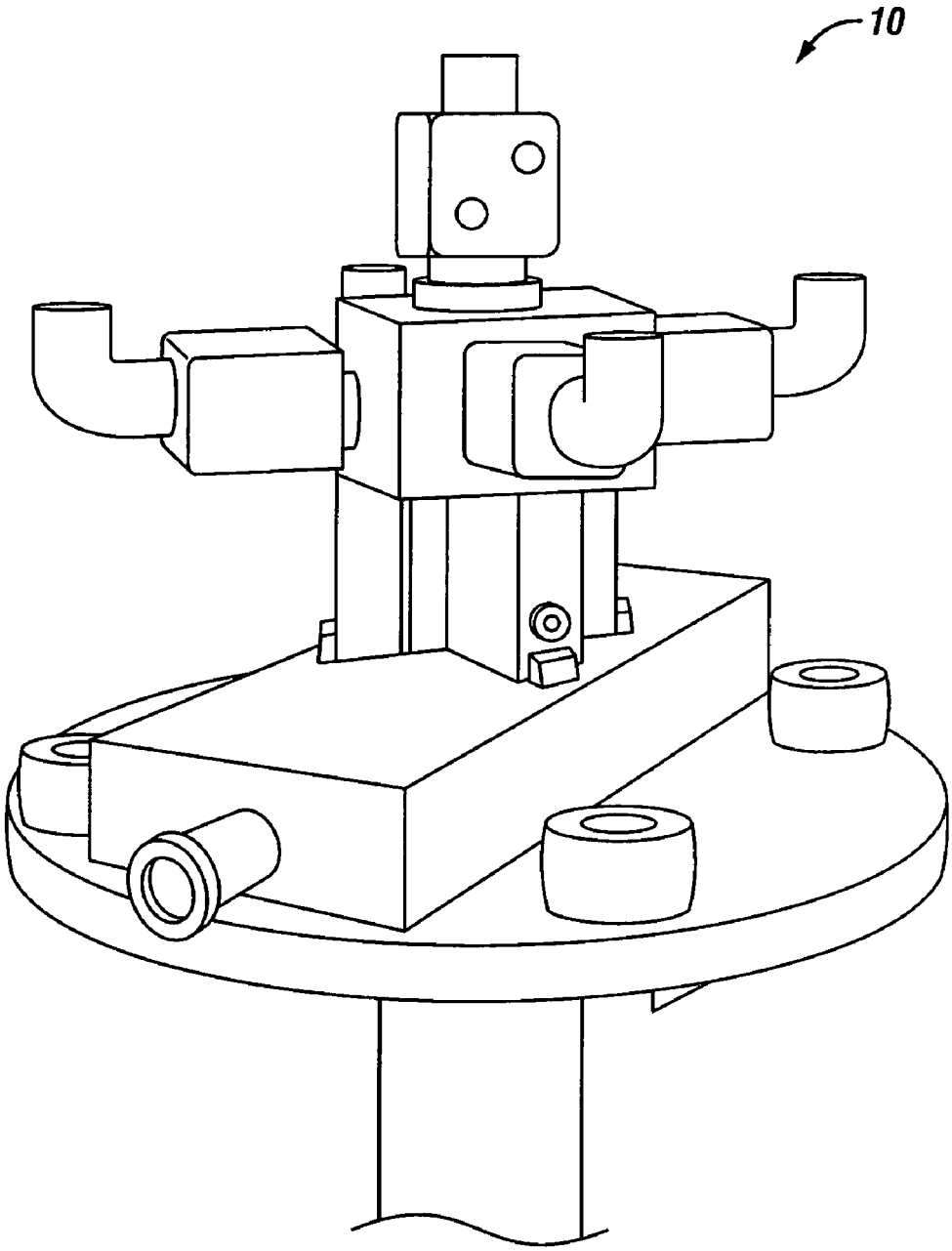
FIG. 2 is a perspective view of the well production hub of FIG. 1

FIGS. 1 and 2 illustrate a well production and multi-purpose intervention access hub 10 used in a well field architecture to fluidly communicate and allow mechanical intervention tool access with at least one oil and/or gas well 12. Once each well 12 is drilled and cased, a production tubing is installed within the casing thus creating an annulus between the production tubing and the casing. A production tree 14 is then installed on each wellhead to control fluid flow into and out of each well 12 either through the production tubing or through the production tubing annulus. Attached to each well tree 14 is a well jumper 16 that connects each well 12 to the well production and multi-purpose intervention access hub 10. Production fluids flow from a well 12 to the well production and multi-purpose intervention access hub 10 and then through at least one flowline 40 to a host facility 41. It should also be appreciated that there may be more than one well production and multi-purpose intervention access hub 10 connected to each other to connect multiple well fields before fluid flow back to a host facility 41.

The well production and multi-purpose intervention access hub 10 comprises a production header module 18 that accepts connection from at least one well 12 through a well jumper 16. The well production and multi-purpose intervention access hub 10 further comprises a flowline header module 20 that connects to the production header module 18. It should be appreciated that the production header module 18 and the flowline header module 20 may be incorporated into a single unit to form the well production and multi-purpose intervention access hub 10. The well production and multi-purpose intervention access hub 10 may be installed on a modular interface platform 22 connected to a monopile support 24. It should be appreciated though that the well production and multi-purpose intervention access hub 10 may be installed on any suitable support and is not limited to installation on a modular interface platform 22 and monopile 24. The well production and multi-purpose intervention access hub 10, modular interface platform 22, and monopile 24 are capable of installation from a MODU, a drilling service vessel ("DSV"), a multi-service vessel ("MSV"). It should be appreciated that the well production and multi-purpose intervention access hub 10 is not limited to one particular method of deployment and may also be deployed using any other suitable means or method. It should also be appreciated that some or all of the well production and multi-purpose intervention access hub 10, the modular interface platform 22, and/or the monopile 24 may be deployed at different stages of installation.

The monopile 24 is installed on the sea floor using any suitable method such as jetting, gravity base, hammered, or suction techniques. The modular interface platform 22 is installed on the monopile 24. The modular interface platform 22 may comprise self-alignment mechanisms 23 for alignment with the monopile 24 during installation. The connection between the monopile 24 and the modular interface platform 22 may also comprise leveling mechanisms 25 for leveling of the modular interface platform 22 independently of the monopile 24. The connection between the modular interface platform 22 and the monopile 24 may be made up or undone using a remote operated vehicle (ROV) or any other suitable means or method.

The well production and multi-purpose intervention access hub 10 may be installed on the modular interface platform 22 using self-guiding means during installation. The well production and multi-purpose intervention access hub 10 is illustrated in FIGS. 1-7 as having the production header module 18 placed on top of the flowline header module 20. It should be appreciated that the well production and multi-purpose intervention access hub 10 may be arranged in any suitable configuration such as the production header module 18 being below the flowline header module 20. Alternatively, the production header module 18 and the flowline header module 20 may be combined into a single unit without the need for a separate flowline header module 20. Alternatively, the production header module 18 may be installed horizontally offset from the flowline header module 20 with separate tie-ins to the production header module 18. As shown though, the production header module 18 may be installed on top of the flowline header module 20 using self alignment guides 26. Once the life of the wells 12 in the well field are complete, the well production and multi-purpose intervention access hub 10, the modular interface platform 22, and the monopile 24 may also be retrieved to a MODU, DSV, MSV, or other suitable vessel for installation in another well field.

Figure 4:
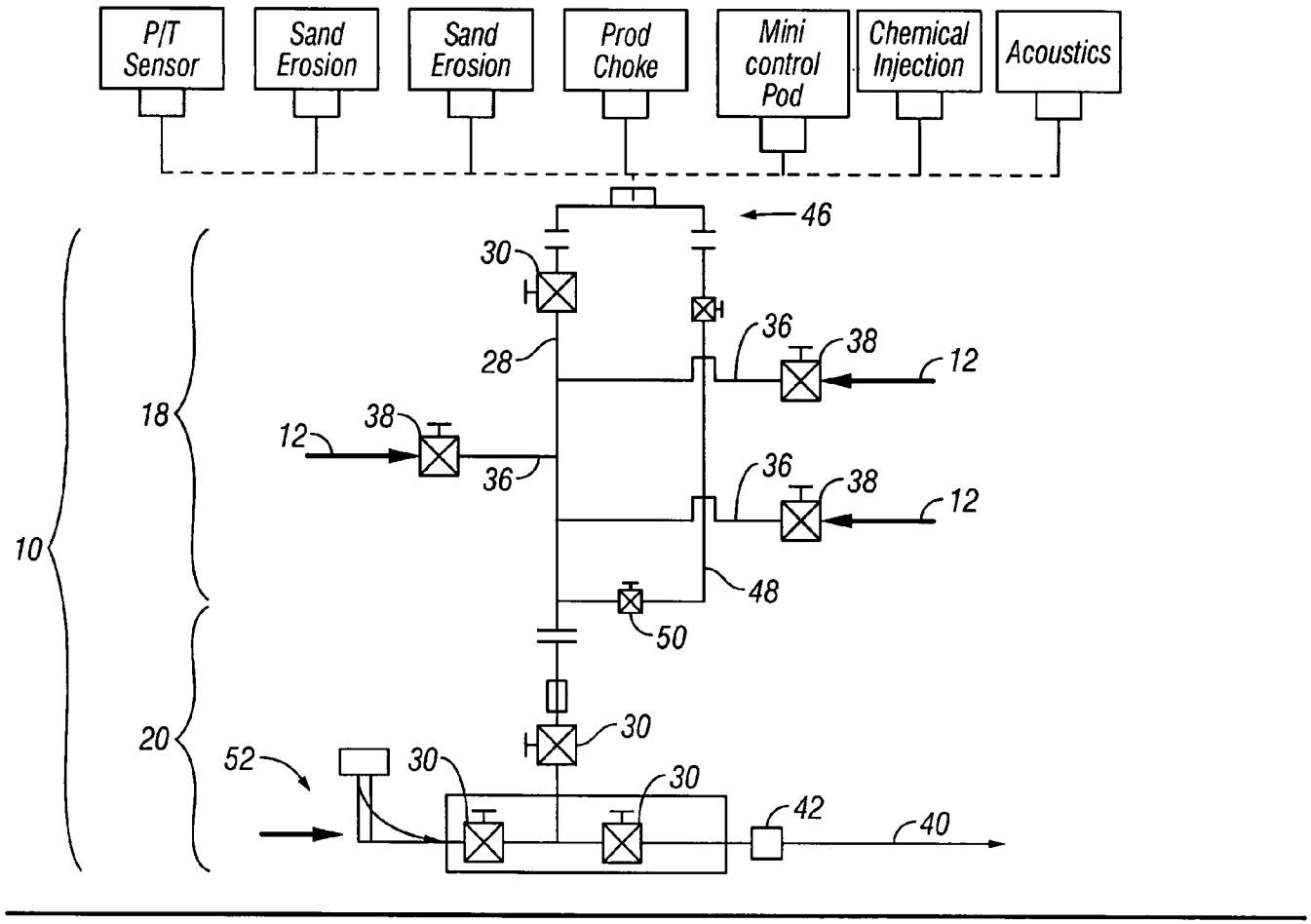
FIG. 4 is a schematic flow diagram of a first embodiment of a well production hub.

In a first embodiment illustrated in FIG. 4, the production header module 18 and the flowline header module 20 combine to form a bore flow system for the flow of fluids either into or out of the wells 12 comprising a single hub bore 28. The production header module 18 may connect to the flowline header module 20 using any suitable type of connection. For example, the bore of the production header module 18 may stab-connect with the bore of the flowline header module 20 with the assistance of an ROV. As shown schematically in FIG. 4, the well production and multi-purpose intervention access hub 10 may comprise at least one bore valve 30. The bore valve(s) 30 may be any suitable type of flow valve and may be controlled by any suitable means. For example, actuator or actuators internal or external to the well production and multi-purpose intervention access hub 10 may control the bore valve(s) 30.

Figure 3:
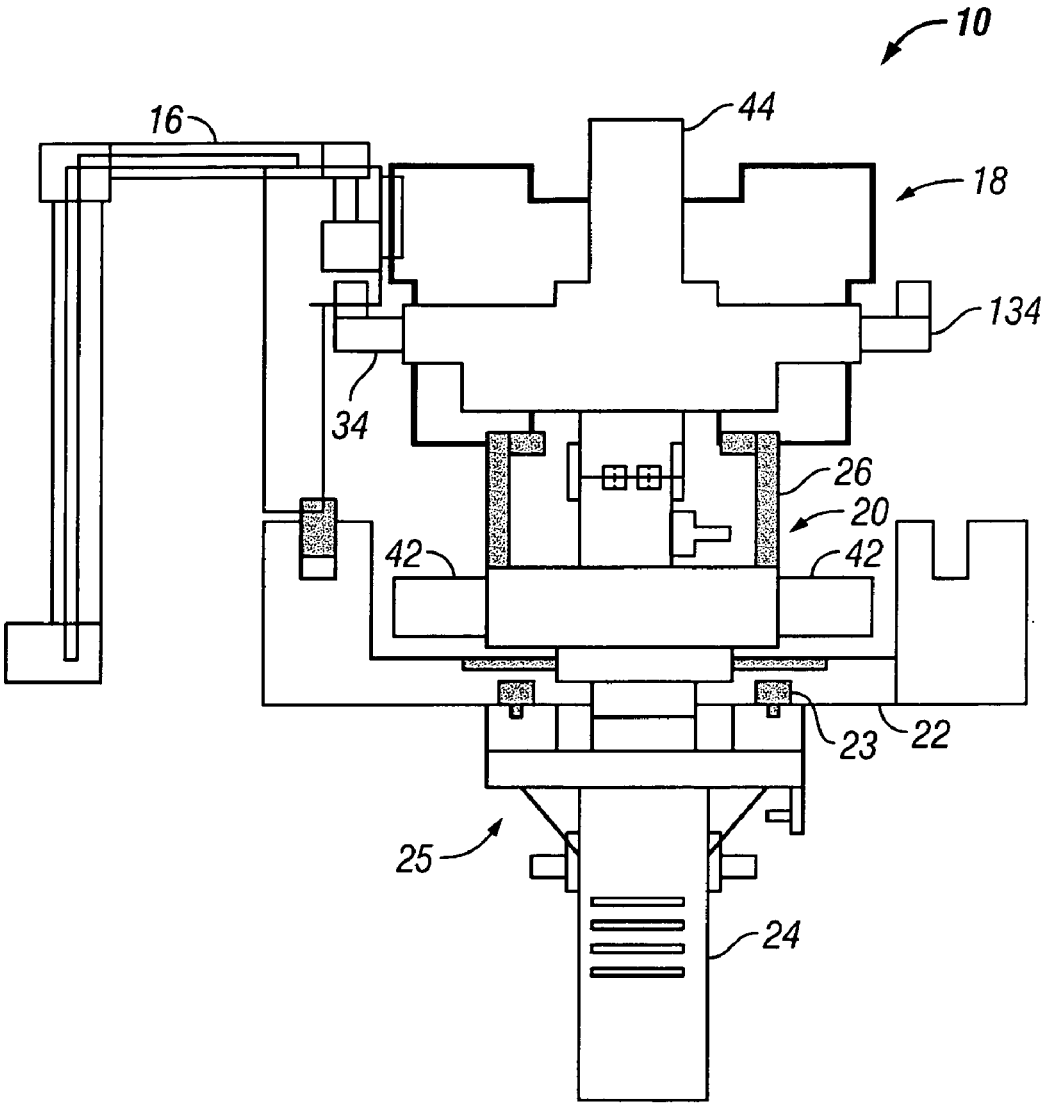
FIG. 3 is schematic side elevation view of the well production hub of FIG. 1.

As shown in FIGS. 3 and 4, the production header module 18 may further comprise at least one well jumper termination coupling 34 for establishing fluid flow with a well 12 through a well jumper 16. As shown schematically in FIG. 4, fluid flow from a well jumper 16 enters the production header module 18 and communicates with the hub bore 28. The production header module 18 may comprise at least one jumper-hub bore 36 for establishing fluid communication between the well jumper 16 and the hub bore 28. One or more jumper-hub bore valve or valves 38 may control fluid flow between the well jumper 16 and the hub bore 28. The jumper-hub bore valve(s) 38 may be controlled by any suitable means. For example, an actuator or actuators may control the jumper-hub bore valve(s) 38. In addition, the actuator(s) may be controlled by any suitable means. For example, the well production and multi-purpose intervention access hub 10 may have an internal controller that is programmable and re-programmable. The well production and multi-purpose intervention access hub 10 may alternatively be controlled through dedicated electronic, hydraulic, or combination electro-hydraulic control communication lines connected to a host facility 41 at the sea surface. Alternatively, the control signals may be transmitted wirelessly between the well production and multi-purpose intervention access hub 10 and a host facility 41. The hub bore 28 extends from the production header module 18 to the flowline header module 20. At least one flowline 40 may connect to at least one flowline connector 42 on the flowline header module 20 for fluid communication between the well production and multi-purpose intervention access hub 10 and a host facility 41 through the flowline or flowlines 40.

With at least one well 12 connected to the well production and multi-purpose intervention access hub 10, the initial stages of production may be performed, such as clean up, flow back, well testing, or other pre-production operations. The production header module 18 further comprises a utility interface 44, to which the hub bore 28 also extends. A cap may be installed on the utility interface 44 to prevent fluid from escaping the production header module 18. However, to perform well operations, the cap may be removed and a utility module adapter 46 may be connected to the utility interface 44. The utility module adapter 46 allows for the connection of a utility module to the well production and multi-purpose intervention access hub 10. It should be appreciated that there may be different utility module adapters 46 having different configurations depending on which utility module is being connected with the well production and multi-purpose intervention access hub 10. It should be appreciated that there may also be more than one utility module connected to the well production and multi-purpose intervention access hub 10. The utility module may be any suitable utility module. For example, the utility module may be a lower marine rise package ("LMRP") that extends to the MODU or other vessel. The LMRP comprises a flowbore that communicates with the hub bore 28 through the use of the utility module adapter 46. With the LMRP connected to the well production and multi-purpose intervention access hub 10, the jumper-hub bore valve(s) 38 may be set to direct flow from a well jumper 16 through the hub bore 28, through the utility module adapter 46 and into the LMRP. The fluids initially produced by a well 12 may then be collected and tested to perform well clean up and well testing operations. Once a well 12 has been tested, flow from the well jumper 16 may then be directed into the flowline header module 20 and out through the flowline(s) 40 to the host facility 41. While connected, the controls on the LMRP may also interface with the controls of the well production and multi-purpose intervention access hub 10 through the utility module adapter 46 to control the hub bore valve(s) 30 and/or the jumper-hub bore valve(s) 38 for directing flow from each well 12 through the hub bore 28. The hub bore valve(s) 30 may also be configured and set to isolate and test one well 12 at a time if more than one well 12 is connected to the well production and multi-purpose intervention access hub 10. The well clean up and test fluids may also be directed to a host facility 41 through the flowline(s) 40 instead of through the LMRP. The well production and multi-purpose intervention access hub 10 may also allow the detachment of the production header module from the flowline header module by the closing of one or more bore valve(s) 30.

During the life of a well 12, it may be necessary to perform intervention operations to improve the fluid flow from the well 12. Intervention operations may comprise any number of different operations. For example, intervention operations may comprise flow assurance management, pressure management, production annulus management, pressure testing, chemical sweeping, circulation and reverse circulation, bullheading, well kill, pigging, fluid sampling, inspection, acoustic testing, metering, production flow management, well isolation, and/or hydrate remediation.

To perform the intervention operations, different utility modules may be connected to the well production and multi-purpose intervention access hub 10. For example, as illustrated in FIG. 4, the utility modules may comprise a pressure/temperature sensor module, a sand erosion sensor module, a production choke module, a control pod module, a chemical injection module, an acoustics system module, and/or an LMRP as discussed above. It should be appreciated that the particular utility module may also be designed to incorporate one or more utilities into one module. There may also be more than one module connected to the well hub 10 at one time. Controls in the well hub 10 or in each utility module may be used to configure the jumper-hub bore valve(s) 38 and/or the hub bore valve(s) 30 to control fluid flow from or into each individual well 12 as well as fluid flow into the flowline(s) 40. In this manner, each well 12 may be isolated and intervention operations performed for that well 12 while any other wells 12 continue to produce production fluids. In addition, multiple wells 12 may be isolated together to allow fluid flow from one well 12 to another well 12. For increased configurability, if there are well jumper connections 34 without a well jumper 16 attached, logic caps may be installed connecting one or more jumper connections 34. Additionally, bridge caps may be installed between at least one unconnected jumper connection 34 and at least one unconnected flowline connector 42.

The well production and multi-purpose intervention access hub 10 may alternatively comprise a utility bore 48 with one or more utility bore valve(s) 50 for controlling fluid flow through the utility bore 48. The utility bore 48 may extend from the utility interface 44 and connect with the hub bore 28. The utility bore 48 allows for an additional circulation connection with the utility module adapter 46 for connecting to a utility module. The utility bore 48 may be used to circulate fluids for any suitable utility. For example, chemicals from a chemical injection module may be injected into the utility bore 48 and thus the hub bore 28 at a selected location or locations. The utility bore 48 allows for adaptability for performing multiple utility operations as well as bore configuration within the well production and multi-purpose intervention access hub 10.

The well production and multi-purpose intervention access hub 10 may comprise one or more flowlines 40 connected to the flowline header module 20 for fluid communication with a host facility 41. Additionally, the flowline connectors 42 may allow for the connection of a tool for flowline remediation illustrated generally in FIG. 4 at 52. Access to at least one flowline 40 from the flowline header module 20 allows for circulation and mechanical intervention tool access to the flowline 40 for intervention operations such as hydrate remediation or chemical injection. Access to the flowline header module 20 also allows for coiled tubing injection into the well production and multi-purpose intervention access hub 10 as well as the flowline 40 for other potential intervention operations. As non-limiting examples, other potential intervention operations may comprise well jumper/flowline hydrate remediation, chemical squeeze operations, bullheading, circulation and displacement of well jumpers and/or a tiebacks, wellbore tubing and production casing annulus management due to thermal expansion or cool down, pig displacement operations, intelligent pigging, internal pipeline survey/inspections, dewatering, commissioning, pipeline wall inspection, and thermal insulation inspection surveys.

Figure 5:
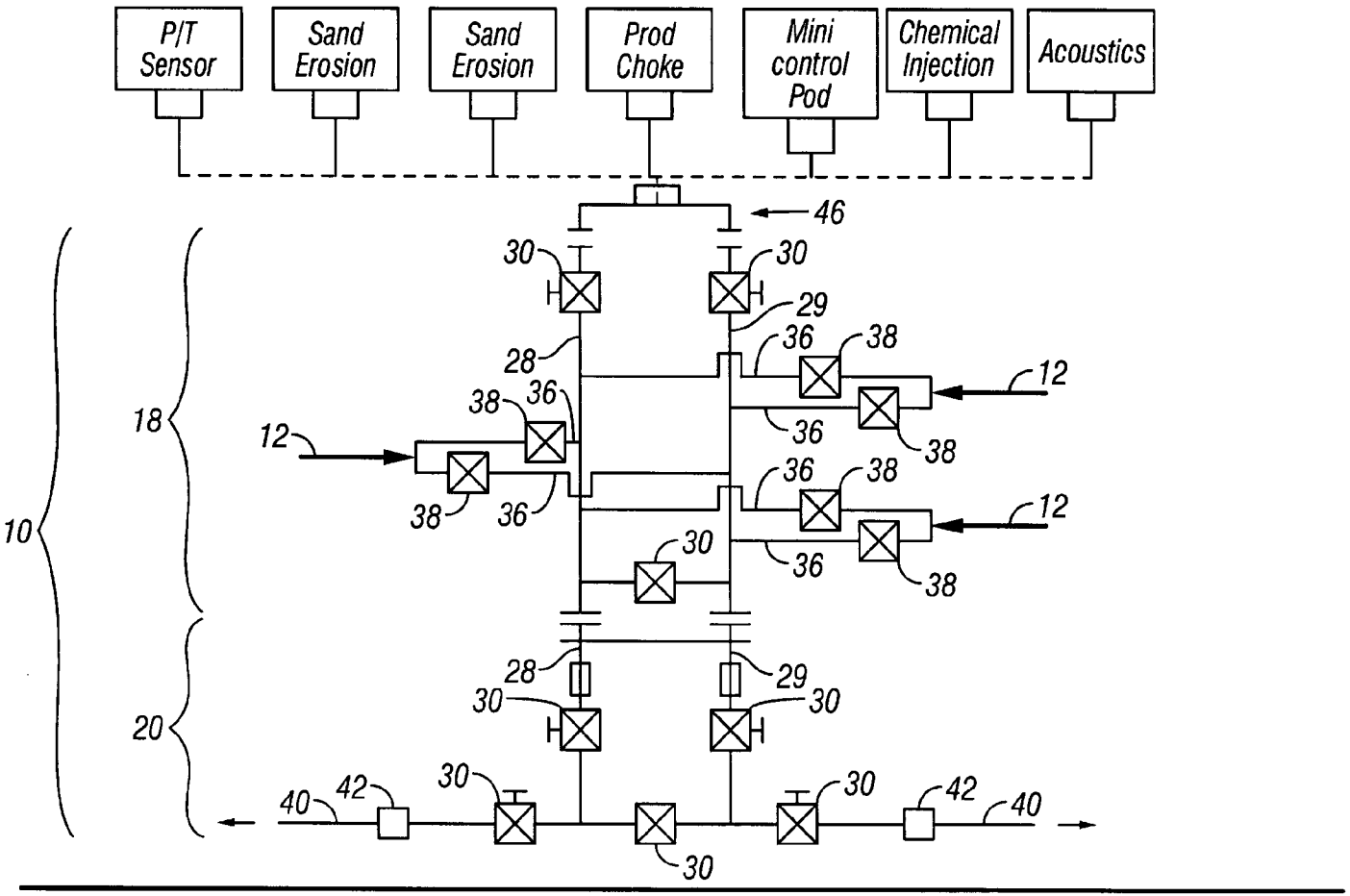
FIG. 5 is a schematic flow diagram of a second embodiment of a well production hub.
Figure 6:
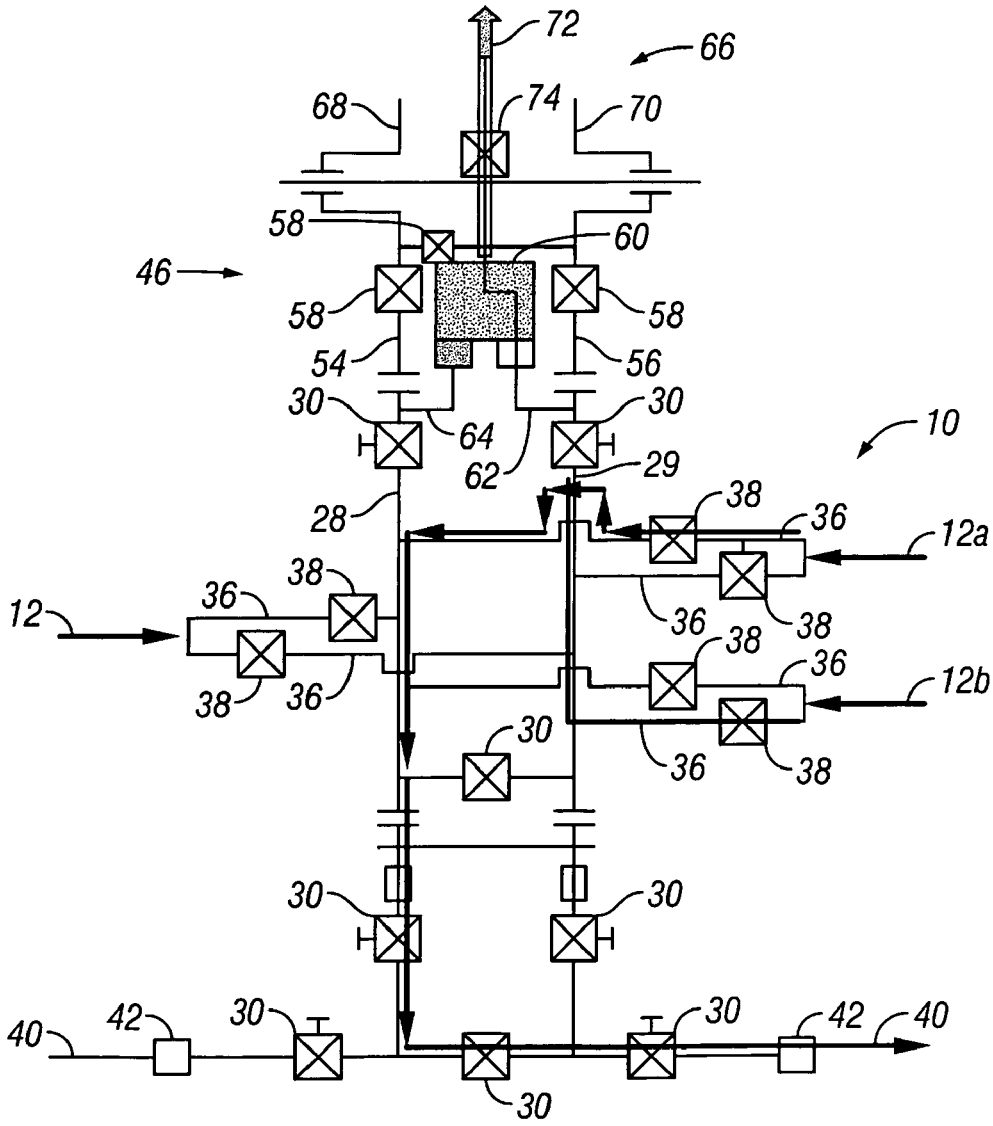
FIG. 6 is a schematic flow diagram of the well production hub of FIG. 5.

In a second embodiment illustrated in FIGS. 5 and 6, the production header module 18 and the flowline header module 20 comprise hub bores 28, 29 to form a multiple bore flow system for the flow of fluids either into or out of the wells 12. It should be appreciated that the well production and multi-purpose intervention access hub 10 may also comprise more than two hub bores depending on the desired configuration of the well production and multi-purpose intervention access hub 10. The production header module 18 may connect to the flowline header module 20 using any suitable type of connection. For example, the bore of the production header module 18 may stab-connect with the bore of the flowline header module 20 with the assistance of an ROV. As shown schematically in FIGS. 5 and 6, the well production and multi-purpose intervention access hub 10 may comprise bore valves 30. The bore valves 30 may be any suitable type of flow valve and may be controlled by any suitable means. For example, actuators internal or external to the well production and multi-purpose intervention access hub 10 may control the bore valves 30.

As shown in FIGS. 3, 5, and 6, the production header module 18 may further comprise at least one well jumper termination coupling 34 for establishing fluid flow with a well 12 through a well jumper 16. As shown schematically in FIGS. 5 and 6, fluid flow from a well jumper 16 enters the production header module 18 and communicates with at least one of the hub bores 28, 29. The production header module 18 may comprise jumper-hub bores 36 for establishing fluid communication between the well jumper 16 and both hub bores 28,29. Jumper-hub bore valves 38 may control fluid flow between the well jumper 16 and the hub bores 28, 29 and may be controlled by any suitable means. For example, actuators may control the jumper-hub bore valves 38. In addition, the actuators may be controlled by any suitable means. For example, the well production and multi-purpose intervention access hub 10 may have an internal controller that is programmable and re-programmable. The well production and multi-purpose intervention access hub 10 may alternatively be controlled through dedicated electronic, hydraulic, or combined electro-hydraulic control communication lines connected to a host facility 41 at the sea surface. Alternatively, the control signals may be transmitted wirelessly between the well production and multi-purpose intervention access hub 10 and a host facility 41. The hub bores 28, 29 extend from the production header module 18 to the flowline header module 20. At least one flowline 40 may connect to at least one flowline connector 42 on the flowline header module 20 for fluid communication between the well production and multi-purpose intervention access hub 10 and a host facility 41 through the flowline or flowlines 40.

With at least one well 12 connected to the well production and multi-purpose intervention access hub 10, the initial stages of production may be performed, such as clean up, flow back, well testing, or other pre-production operations. The production header module 18 further comprises a utility interface 44, to which the hub bores 28, 29 also extend. A cap may be installed on the utility interface 44 to prevent fluid from escaping the production header module 18. However, to perform well operations, the cap may be removed and a utility module adapter 46 may be connected to the utility interface 44. The utility module adapter 46 allows for the connection of a utility module to the well production and multi-purpose intervention access hub 10. It should be appreciated that there may be different utility module adapters 46 having different configurations depending on which utility module is being connected with the well production and multi-purpose intervention access hub 10. It should be appreciated that there may also be more than one utility module connected to the well production and multi-purpose intervention access hub 10. The utility module may be any suitable utility module. For example, the utility module may be a lower marine rise package ("LMRP") that extends to the MODU or other vessel. The LMRP comprises a flowbore that communicates with the hub bores 28, 29 through the use of the utility module adapter 46. With the LMRP connected to the well production and multi-purpose intervention access hub 10, the jumper-hub bore valves 38 are set to direct flow from a well jumper 16 through one or both of the hub bores 28, 29 through the utility module adapter 46 and into the LMRP. The fluids initially produced by a well 12 may then be collected and tested to perform well clean up and well testing operations. Once a well 12 has been tested, flow from the well jumper 16 may then be directed into the flowline header module 20 and out through the flowline(s) 40 to the host facility 41. While connected, the controls on the LMRP may also interface with the controls of the well production and multi-purpose intervention access hub 10 through the utility module adapter 46 to control the hub bore valves 30 and/or the jumper-hub bore valves 38 for directing flow from each well 12 through the hub bore 28. The hub bore valves 30 may also be configured and set to isolate and test one well 12 at a time if more than one well 12 is connected to the well production and multi-purpose intervention access hub 10. This can be performed by configuring the hub bore valves 30 and the jumper-hub bore valves 38 to isolate fluid flow from one well 12 to the LMRP through one of the hub bores, either 28 or 29. The other well or wells 12 may continue to produce fluids by configuring the hub bore valves 30 and the jumper-hub bore valves 38 to direct flow into the other of the hub bores, either 28 or 29, into the flowline header module 20, and into the flowline(s) 40. The well clean up and test fluids may also be directed to a host facility 41 through the flowline(s) 40 instead of through the LMRP. The well production and multi-purpose intervention access hub 10 may also allow the detachment of the production header module from the flowline header module by the closing of one or more bore valve(s) 30.

During the life of a well 12, it may be necessary to perform intervention operations to improve the fluid flow from the well 12. Intervention operations may comprise any number of different operations. For example, intervention operations may comprise flow assurance management, pressure management, production annulus management, pressure testing, chemical sweeping, circulation and reverse circulation, bullheading, well kill, pigging, fluid sampling, inspection, acoustic testing, metering, production flow management, well isolation, and/or hydrate remediation.

To perform the intervention operations, different utility modules may be connected to the well production and multi-purpose intervention access hub 10. For example, as illustrated in FIGS. 5 and 6, the utility modules may comprise a pressure/temperature sensor module, a sand erosion sensor module, a production choke module, a control pod module, a chemical injection module, an acoustics system module, and/or an LMRP. It should be appreciated that the particular utility module may also be designed to incorporate one or more utilities into one module. There may also be more than one module connected to the well hub 10 at one time. Controls in the well hub 10 or in each utility module may be used to configure the jumper-hub bore valves 38 and/or the hub bore valves 30 to control fluid flow from or into each individual well 12 as well as fluid flow into the flowline(s) 40. In this manner, each well 12 may be isolated and intervention operations performed for that well 12 while any other wells 12 continue to produce production fluids. In addition, multiple wells 12 may be isolated together to allow fluid flow from one well 12 to another well 12. For increased configurability, if there are well jumper connections 34 without a well jumper 16 attached, logic caps may be installed connecting one or more jumper connections 34. Additionally, bridge caps may be installed between at least one unconnected jumper connection 34 and at least one unconnected flowline connector 42.

Fluid flow to or from a well 12 may be isolated from any other wells using the ability to direct flow to or from a particular well 12 through either hub bore 28 or hub bore 29. Having no re than one hub bore 28, 29 also allows for an additional circulation connection with the utility module adapter 46 for connecting to a utility module. The hub bores 28, 29 and the jumper-hub bores 36 may be used to circulate fluids for any suitable utility. For example, chemicals from a chemical injection module may be injected into one or both of the hub bores 28, 29. Multiple hub bores 28, 29 also allows for adaptability for performing multiple utility operations as well as bore configuration within the well production and multi-purpose intervention access hub 10 depending on the need for isolating fluid flow of a well 12 from other wells 12.

FIG. 6 illustrates an example of performing different operations on the wells 12 simultaneously. As shown, the well 12*a* has been cleaned out and tested and is producing through jumper-hub bore 36 to hub bore 28 and out through flowline 40. To perform well clean up, testing, or other intervention operations, an LMRP 66 is connected to the well production and multi-purpose intervention access hub 10 using an LMRP adapter 46. The LMRP adapter 46 connects the hub bores 28, 29 with the choke line 68 and kill line 70 of the LMRP 66 using adapter bores 54, 56 in the adapter 46. Adapter bore valves 58 control flow through the adapter bores 54 and 56 and may be controlled by any suitable means. For example the adapter bore valves 58 may be controlled by actuators controlled with controls on the LMRP 66 or in the well production and multi-purpose intervention access hub 10. The LMRP adapter 46 may further comprise adapter bores 62, 64 for directing fluid flow through a tie back tool 60 and into a tieback bore 72 of the LMRP 66. Flow through the tieback bore 72 of the LMRP 66 may further be controlled using high pressure bore isolation valve 74.

As illustrated, while the well 12*a* may be producing fluids into the hub bore 28, the well 12*b* may produce fluids into the well hub 10 through the jumper-hub bore 36 and into the hub bore 29. The fluid the hub bore 29 may then flow into the LMRP adapter 46, through the adapter bore 62 and the tie back tool 60, and into the tieback bore 72 of the LMRP 66. The fluids produced by the well 12*b* may then be collected and tested to perform well clean up, well testing, or other intervention operations. Once the operations have been performed, flow from the well 12*b* may then be directed into the flowline header module 20 either through the hub bore 28 or 29 and out through the flowline(s) 40 to the host facility 41.

The well production and multi-purpose intervention access hub 10 may comprise one or more flowlines 40 connected to the flowline header module 20 for fluid communication with a host facility 41. Although not illustrated in FIGS. 5-6, the flowline connectors 42 may also allow for the connection of a tool for flowline remediation illustrated generally in FIG. 4 at 52. Access to at least one flowline 40 from the flowline header module 20 allows for circulation and mechanical intervention tool access to the flowline 40 for intervention operations such as hydrate remediation or chemical injection. Access to the flowline header module 20 also allows for coiled tubing injection into the well production and multi-purpose intervention access hub 10 as well as the flowline 40 for other potential intervention operations. By way of non-limiting example, other potential intervention operations may comprise well jumper/flowline hydrate remediation, chemical squeeze operations, bullheading, circulation and displacement of well jumpers and/or a tiebacks, wellbore tubing and production casing annulus management due to thermal expansion or cool down, pig displacement operations, intelligent pigging, internal pipeline survey/inspections, dewatering, commissioning, pipeline wall inspection, and thermal insulation inspection surveys.

Figure 7:
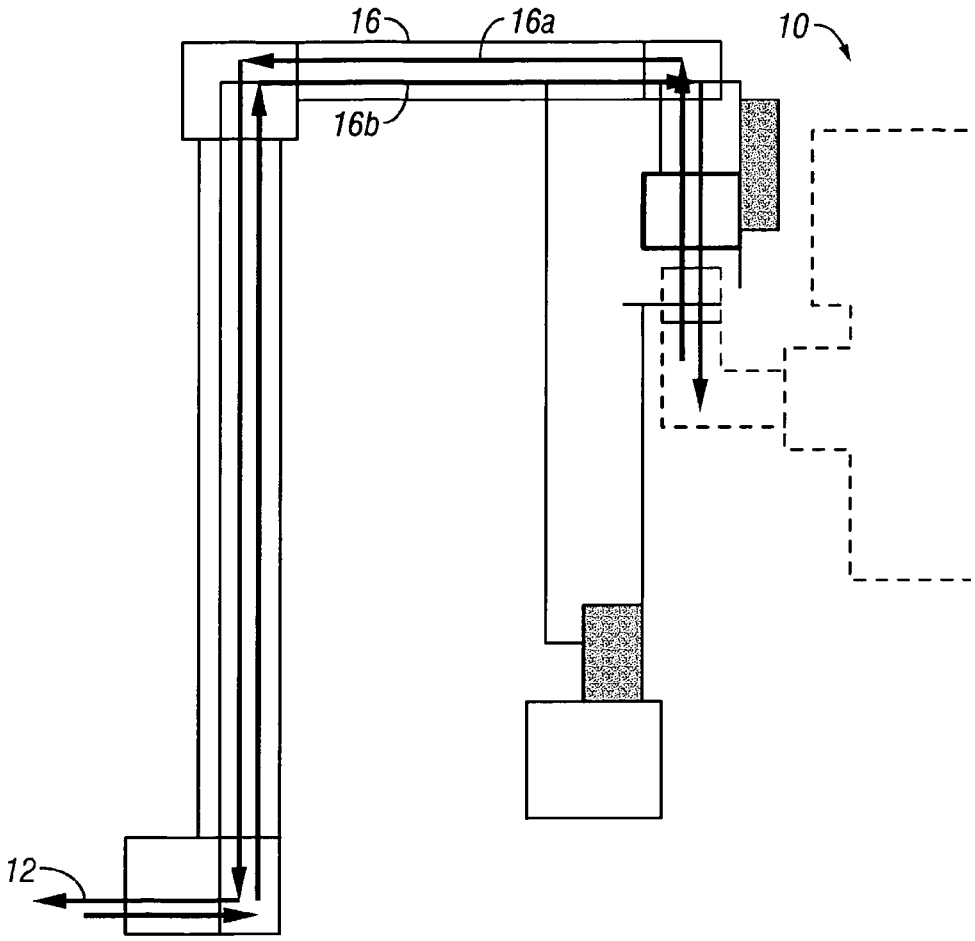
FIG. 7 is a schematic flow diagram of a dual bore well jumper for the well production hub.

The well jumper(s) 16 may either be single or dual bore well jumpers. Single bore well jumpers allow fluid flow in one direction at a time through the well jumper 16. As illustrated in FIG. 7, however, the dual bore well jumper 16 allows fluid flow through the well jumper 16 in different directions at the same time with the fluid flow in one direction being isolated from the fluid flow in the other direction. The dual bore well jumper 16 also allows the flow of different fluids in the same direction, the fluid in one bore being isolated from the fluid flow in the second bore. The dual bore well jumper 16 comprises a first jumper bore 16*a* within a second jumper bore 16*b*. The first jumper bore 16*a* is illustrated as being concentric to the second jumper bore 16*b*. However, the first jumper bore 16*a* may also be offset from the center of the second jumper bore 16*b*. The dual bore well jumper 16 may comprise crossovers at the junctions and terminal ends to allow the fluid flow through the first, or inner jumper bore 16*a* to exit from the second, or outer jumper bore 16*b*.

The dual bore well jumper 16 allows intervention procedures to be performed by allowing access to the production tubing in the well 12 as well as the production tubing annulus simultaneously. Thus, fluids may be circulated from the well production and multi-purpose intervention access hub 10 and into the production tubing through the first jumper bore 16*a*. From the production tubing, the fluids may circulate back up the production tubing annulus and back to the well production and multi-purpose intervention access hub 10 though the second jumper bore 16*b*. Additionally, fluids from the production tubing may flow through the first jumper bore 16*a* to the well production and multi-purpose intervention access hub 10 at the same time as fluid from the production tubing annulus flows through the jumper bore' 16*b* to the well production and multi-purpose intervention access hub 10. This allows for simultaneous annulus pressure management while production fluids are still being produced from the well 12. Another example is if a packer sealing the production tubing annulus begins to leak, a gas cap may be injected through the second jumper bore 16*b* to control the pressure in the production tubing annulus.

The jumper bores 16*a, b*. provide independent pressure and fluid conduits to each other. Design of the flow path at terminations, joints, pipe unions, and elbows will be configures with a series of ports allowing flow in the jumper bore 16*b* to be sealed and isolated from the well jumper bore 16*a*. With dual bore jumper bores 16*a, b*, all connectors will be dual bore allowing fluids within the jumper bores 16*a*, 16*b* to be independently isolated. The dual bore connectors will comprise an outer isolation sleeve to seal jumper bore 16*b* from the environment. The connectors will further comprise an inner isolation sleeve to form an isolation between the jumper bores 16*a, b*. The connectors may further comprise cross ports as well as inner and outer seals retained on the inner and outer isolation sleeves to establish pressure integrity for inner bore 16*a*.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A well production and multi-purpose intervention access hub for flowing fluids from multiple wells to a host facility through a flowline and capable of interaction with a utility module comprising:

a production header module comprising a utility interface;

a flowline header module configured for fluid communication with the flowline;

said production header module and said flowline header module being fluidly connected to form a hub bore, said hub bore being in fluid communication with the flowline and extending through said utility interface;

said production header module comprising well jumper-hub bores allowing fluid communication between the wells and said hub bore;

a utility module adapter configured for connection with said utility interface, said utility module adapter allowing the connection of the utility module with said well production and multi-purpose intervention access hub, the utility module being in fluid communication with said hub bore upon connection;

valves for controlling fluid flow through said well production and multi-purpose intervention access hub and allowing the isolation of fluid communication between a well and said hub bore from the fluid communication between another well and said hub bore; and said valves allowing fluid communication between an isolated well and the utility module upon connection of the utility module.

2. The well production and multi-purpose intervention access hub of claim 1 further comprising said production header module and said flowline header module being fluidly connected to form a utility bore, said utility bore allowing fluid communication and mechanical access between the utility module and said hub bore.

3. The well production and multi-purpose intervention access hub of claim 1 further comprising more than one hub bore, each hub bore in fluid communication with at least one well such that fluid communication with a well may be isolated from fluid communication with other wells.

4. The well production and multi-purpose intervention access hub of claim 1 further comprising a dual bore jumper, each jumper bore providing fluid communication between a flow bore of a well and said hub bore such that multiple fluids may communicate between a well and said hub bore both simultaneously and independently.

5. The well production and multi-purpose intervention access hub of claim 1 wherein said production header module is installed in direct contact with said flowline header module.

6. The well production and multi-purpose intervention access hub of claim 1 further comprising more than one production header module.

7. The well production and multi-purpose intervention access hub of claim 1 wherein said production header module is removable and re-attachable to said flowline header module, said valves closing fluid communication in said hub bore between said flowline header module and said production header module while said production header module is detached.

8. The well production and multi-purpose intervention access hub of claim 1 further comprising said production header module being integral with said flowline header module.

9. The well production and multi-purpose intervention access hub of claim 1 further comprising said well production and multi-purpose intervention access hub being connectable with at least one other well production and multi-purpose intervention access hub.

10. The well production and multi-purpose intervention access hub of claim 1 wherein.

said flowline header module further comprises a flowline connector for connecting said flowline header module with the flowline; and said flowline connector allowing the connection of a flowline tool for fluid communication or mechanical intervention with the flowline or said well production and multi-purpose intervention access hub through said flowline connector.

11. A subsea well production system capable of interaction with a utility module comprising:

multiple subsea wells;

a well production and multi-purpose intervention access hub comprising:

a production header module comprising a utility interface, a flowline header module configured for fluid communication with a flowline connected to a host facility;

said production header module and said flowline header module being fluidly connected to form a hub bore, said hub bore being in fluid communication with said flowline and extending through said utility interface;

said production header module comprising jumper-hub bores for providing fluid communication between said wells and said hub bore;

a utility module adapter configured for connection with said utility interface, said utility module adapter allowing the connection of the utility module with said well production and multi-purpose intervention access hub, the utility module being in fluid communication with said hub bore upon connection;

valves for controlling fluid flow through said well production and multi-purpose intervention access hub and allowing the isolation of fluid communication between a well and said hub bore from the fluid communication between another well and said hub bore; and said valves allowing fluid communication between an isolated well and the utility module upon connection of the utility module; and said well production and multi-purpose intervention access hub in fluid communication with said multiple wells;

said well production and multi-purpose intervention access hub in fluid communication with a host facility through a flowline.

12. The subsea well production system of claim 11 further comprising said production header module and said flowline header module being fluidly connected to form a utility bore, said utility bore allowing fluid communication and mechanical access between the utility module and said hub bore.

13. The subsea well production system of claim 11 further comprising more than one hub bore, each hub bore in fluid communication with at least one well such that fluid communication with a well may be isolated from fluid communication with other wells.

14. The subsea well production system of claim 11 further comprising a dual bore jumper, each jumper bore providing fluid communication between a flow bore of a well and said hub bore such that multiple fluids may communicate between a well and said hub bore both simultaneously and independently.

15. The subsea well production system of claim 11 wherein said production header module is installed in direct contact with said flowline header module.

16. The subsea well production system of claim 11 further comprising more than one production header module.

17. The well production and multi-purpose intervention access hub of claim 11 wherein said production header module is removable and re-attachable to said flowline header module, said valves closing fluid communication in said hub bore between said flowline header module and said production header module while said production header module is detached.

18. The subsea well production system of claim 11 further comprising said production header module being integral with said flowline header module.

19. The subsea well production system of claim 11 further comprising said well production and multi-purpose intervention access hub being connectable with at least one other well production and multi-purpose intervention access hub.

20. The subsea well production system of claim 11 wherein:

said flowline header module further comprises a flowline connector for connecting said flowline header module with the flowline; and said flowline connector allowing the connection of a flowline tool for fluid communication or mechanical intervention with the flowline or said well production and multi-purpose intervention access hub through said flowline connector.

21. A method of managing fluid production from multiple wells to a host facility through a flowline and using a utility module comprising:

flowing fluid between the wells and a production header module comprising a utility interface, flowing fluid between said production header module and a flowline header module using a hub bore fluidly connecting said production header module and said flowline header module and extending through said utility interface;

flowing fluid between said hub bore in said flowline header module and the host facility through the flowline;

isolating fluid communication between a well and said hub bore from the fluid communication between another well and said hub bore;

attaching a utility module adapter to said utility interface;

attaching the utility module to said utility module adapter, the utility module being in fluid communication with said hub bore upon connection;

flowing fluid between the utility module and the isolated well.

22. The method of claim 21 further comprising flowing fluid from a well through the flowline while flowing fluid between the utility module and the isolated well.

23. The method of claim 21, further comprising flowing fluid between said production header module and a flowline header module using a utility bore fluidly connecting said production header module and said flowline header module, said utility bore being separate from and connected to said hub bore.

24. The method of claim 21 further comprising flowing fluid between said production header module and said flowline header module using more than one hub bore fluidly connecting said production header module and said flowline header module, each hub bore in fluid communication with at least one well such that fluid communication with a well may be isolated from fluid communication with other wells.

25. The method of claim 21 further comprising flowing fluid between the wells and said production header module through a dual bore jumper, each jumper bore providing fluid communication between a flow bore of a well and said hub bore such that multiple fluids may communicate between a well and said hub bore both simultaneously and independently.

26. The method of claim 21 wherein said production header module is installed in direct contact with said flowline header module.

27. The method of claim 21 further comprising flowing fluid between said flowline header module and more than one production header module.

28. The method of claim 21 further comprising said production header module being integral with said flowline header module.

29. The method of claim 21 further comprising connecting more than one well production and multi-purpose intervention access hub in fluid communication with each other.

30. The method of claim 21 wherein:

connecting the flowline to said flowline header module with a flowline connector in fluid communication with said flowline header module and the flowline;

connecting a flowline tool to said flowline connector, and flowing fluid between said flowline tool and said flowline connector.

31. The method of claim 21 further comprising flowing fluid through said well production and multi-purpose intervention access hub to perform a well operation selected from the group consisting of clean up, flow back, well testing, flow assurance management, pressure management, production annulus management, pressure testing, chemical sweeping, chemical squeeze operations, circulation, corrosion management, de-waxing, scale removal, bullheading, well kill, pigging, fluid sampling, inspection, dewatering, commissioning, acoustic testing, metering, production flow management, well isolation, and hydrate remediation.

32. The method of claim 21 further comprising performing mechanical tool intervention through said hub bore from the outside of said production header module or said flowline header module.

33. A method of managing fluid production from multiple wells using a utility module comprising:

flowing fluid between the wells and a production header module comprising a utility interface;

flowing fluid between said production header module and a flowline header module using a hub bore fluidly connecting said production header module and said flowline header module and extending through said utility interface;

flowing fluid between said hub bore and a host facility through a flowline;

isolating fluid communication between a well and said hub bore from the fluid communication between another well and said hub bore;

attaching a utility module adapter to said utility interface;

attaching the utility module to said utility module adapter, the utility module being in fluid communication with said hub bore upon connection;

flowing fluid between the utility module and the isolated well.

34. The method of claim 33 further comprising flowing fluid from a well through said flowline while flowing fluid between the utility module and the isolated well.

35. The method of claim 33 further comprising flowing fluid between said production header module and a flowline header module using a utility bore fluidly connecting said production header module and said flowline header module, said utility bore being separate from and connected to said hub bore.

36. The method of claim 33 further comprising flowing fluid between said production header module and said flowline header module using more than one hub bore fluidly connecting said production header module and said flowline header module, each hub bore in fluid communication with at least one well such that fluid communication with a well may be isolated from fluid communication with other wells.

37. The method of claim 33 further comprising flowing fluid between the wells and said production header module through a dual bore jumper, each jumper bore providing fluid communication between a flow bore of a well and said hub bore such that multiple fluids may communicate between a well and said hub bore both simultaneously and independently.

38. The method of claim 33 wherein said production header module is installed in direct contact with said flowline header module.

39. The method of claim 33 further comprising flowing fluid between said flowline header module and more than one production header module.

40. The method of claim 33 further comprising said production header module being integral with said flowline header module.

41. The method of claim 33 further comprising connecting more than one well production and multi-purpose intervention access hub in fluid communication with each other.

42. The method of claim 33 wherein:

connecting said flowline to said flowline header module with a flowline connector in fluid communication with said flowline header module and said flowline;

connecting a flowline tool to said flowline connector; and flowing fluid between said flowline tool and said flowline connector.

43. The method of claim 33 further comprising flowing fluid through said well production and multi-purpose intervention access hub to perform a well operation selected from the group consisting of clean up, flow back, well testing, flow assurance management, pressure management, production annulus management, pressure testing, chemical sweeping, chemical squeeze operations, circulation, bullheading, well kill, pigging, fluid sampling, inspection, dewatering, commissioning, acoustic testing, metering, production flow management, well isolation, or hydrate remediation.

44. The method of claim 33 further comprising performing mechanical tool intervention through said hub bore from the outside of said production header module or said flowline header module.

45. The well production and multi-purpose intervention access hub of claim 1, said hub bore further being in fluid communication with the annulus bore and the production bore both collectively and independently of at least one of the wells.

46. The well production and multi-purpose intervention access hub of claim 3 wherein fluid communication with a well may be isolated from fluid communication with other wells while the other wells simultaneously continue to produce fluid.

47. The well production and multi-purpose intervention access hub of claim 4 wherein fluid communication between a flow bore of a well and said hub bore includes at least one of fluid venting and fluid pressurization.

48. The subsea well production system of claim 11, said hub bore further being in fluid communication with the annulus bore and the production bore both collectively and independently of at least one of the Subsea wells.

49. The subsea well production system of claim 13 wherein fluid communication with a well may be isolated from fluid communication with other wells while the other wells simultaneously continue to produce fluid.

50. The subsea well production system of claim 14 wherein fluid communication between a flow bore of a well and said hub bore includes at least one of fluid venting and fluid pressurization.

51. The method of claim 21 further comprising said hub bore being in fluid communication with the annulus bore and the production bore both collectively and independently of at least one of the wells.

52. The method of claim 21 wherein flowing fluid between the wells and said production header module further comprises at least one of fluid venting and fluid pressurization.

53. The method of claim 24 wherein flowing fluid between said production header module and said flowline header module using more than one hub bore further comprises isolating fluid communication with a well from fluid communication with other wells while the other wells simultaneously continue to produce fluid.

54. The method of claim 33 further comprising said hub bore being in fluid communication with the annulus bore and the production bore both collectively and independently of at least one of the wells.

55. The method of claim 33 wherein flowing fluid between the wells and said production header module further comprises at least one of fluid venting and fluid pressurization.

56. The method of claim 36 wherein flowing fluid between said production header module and said flowline header module using more than one hub bore further comprises isolating fluid communication with a well from fluid communication with other wells while the other wells simultaneously continue to produce fluid.

* * * * *